US006079597A

United States Patent [19]

Rauworth et al.

[11] Patent Number: 6,079,597

[45] Date of Patent: Jun. 27, 2000

[54] CONTAINMENT SYSTEM

[75] Inventors: Barry L. Rauworth, Young America; John M. Hennan, Eden Prairie, both of Minn.

[73] Assignee: Fluoroware, Inc., Chaska, Minn.

[21] Appl. No.: 09/025,821

[22] Filed: Feb. 19, 1998

[51] Int. Cl.[7] ..... B65D 83/00

[52] U.S. Cl. ..... 222/400.7; 222/464.1; 137/212; 285/921

[58] Field of Search ..... 222/464.1, 538, 222/568, 400.7; 137/212; 285/921

[56] References Cited

U.S. PATENT DOCUMENTS

| | | | |
|---|---|---|---|
| 3,720,355 | 3/1973 | Johnston . | |
| 3,743,145 | 7/1973 | Johnston | 222/400.7 |
| 3,776,260 | 12/1973 | Ruddick . | |
| 3,868,049 | 2/1975 | Johnston | 222/400.7 |
| 3,891,118 | 6/1975 | Laurizio . | |
| 4,093,124 | 6/1978 | Morane et al. . | |
| 4,114,779 | 9/1978 | Stoll, III . | |
| 4,212,414 | 7/1980 | Beyens . | |
| 4,231,489 | 11/1980 | Malone . | |
| 4,625,889 | 12/1986 | Baughman . | |
| 4,699,298 | 10/1987 | Grant et al. . | |
| 4,972,568 | 11/1990 | Schurr . | |
| 5,102,010 | 4/1992 | Osgar et al. . | |
| 5,108,015 | 4/1992 | Rauworth et al. . | |
| 5,118,015 | 6/1992 | Scholle et al. . | |
| 5,199,613 | 4/1993 | Magrath et al. | 285/921 |
| 5,204,499 | 4/1993 | Favalora | 285/921 |
| 5,335,821 | 8/1994 | Osgar . | |
| 5,413,240 | 5/1995 | Hunter et al. . | |
| 5,511,692 | 4/1996 | Willingham . | |
| 5,526,956 | 6/1996 | Osgar . | |
| 5,636,769 | 6/1997 | Willingham . | |
| 5,667,253 | 9/1997 | Jansen et al. . | |

FOREIGN PATENT DOCUMENTS

| | | |
|---|---|---|
| 2168314 | 6/1986 | United Kingdom . |

*Primary Examiner*—Philippe Derakshani
*Attorney, Agent, or Firm*—Douglas J. Christensen

[57] ABSTRACT

A blow molded drum has a port including a neck with exterior buttress threads and a port opening having a sleeve fusion bonded in the neck. The sleeve having a inner cylindrical sealing surface, and a shoulder. A drop-in down tube assembly seats with the shoulder and has an upwardly extending nipple. Either a dispense head or a closure radially seals within the sleeve and is secured by a retainer with interior buttress threads engaging with the exterior threads on the port neck. The dispense head has a first flow duct extending to a nipple engaging portion to seal with the upwardly extending nipple and a second flow duct leading to an annular space around the nipple for a return fluid line or for providing air or a gas for displacing withdrawn fluid. The closure is preferably comprised of a cylindrically shaped interior liner portion for engaging and sealing with the cylindrical sealing surface of the sleeve, such as by an o-ring, and has a pathway which includes the spiral gap between the cooperating buttress threads on the neck and on the retainer. A microporous membrane may be placed in the pathway to allow venting of gases but preclude leakage of the liquid in the drum.

26 Claims, 5 Drawing Sheets

CONTAINMENT SYSTEM

BACKGROUND OF THE INVENTION

This invention relates to containment systems and more particularly containment systems for use in the semiconductor processing industry comprising plastic drums with ports and fitting assemblages for connecting to/or closing said ports.

Blow molded thermoplastic drums have replaced steel drums in many applications. Particularly in the semiconductor processing industry, the chemicals to be contained are highly pure, react with, and are contaminated by contact with metals. Such drums are typically blow molded of high density polyethylene. It is appropriate to eliminate any additives in the polyethylene (PE) which contacts the fluid in the drum and the fitting assemblages system since such additives may diffuse into the highly pure chemicals and contaminate same. Such drums are subject to Department of Transportation regulations which require that the exterior of the drum has ultraviolet inhibitors to prevent or minimize the degradation of the drum. The need to have additives in the PE at the exterior of the drum and the need to have highly pure PE on the interior fluid contacting surfaces has been addressed by the use of a multiple layered parison during the blow molding of the drums.

Known plastic drum containment systems for use in containing and dispensing highly pure chemicals have been structurally complex with numerous seals and therefore are relatively expensive. The expense often dictates that the system components must be used multiple times rather than allowing a single use. The complexity is due in part to the need to provide port connections and closures of very high integrity while overcoming the deficiencies in the blow molding process. These deficiencies relate primarily to the high tolerances inherent in the formation of threaded surfaces and sealing surfaces at the port during the blow molding process. Conventionally the systems will utilize interior threads on the drum neck which are formed during the blow molding process. Secondary fittings will threadingly engage with the neck and will trap and axially compress sealing rings between the secondary fitting and the top edge or at least an upwardly facing surface of the neck. The injection molded secondary fitting will then provide appropriate precision threaded surfaces and sealing surfaces for attachment of closures or dispense heads. See, for example, U.S. Pat. Nos. 5,526,956; 5,511,692; 5,667,253; 5,636,769; and 5,108,015. Conventionally, such connections between the secondary fitting and closure or dispense head will use axially loaded o-rings. In containment systems as such, axially loaded o-rings tend to need replacement more frequently than desired and tightening torques of the dispense heads and closures are more critical than desirable. A sealing system is needed that provides longer lasting o-rings and less critical tightening torque requirements.

Moreover, these secondary fittings typically require significant annular space in that they are in engagement with the inside threads of the neck of the drum port. This use of space restricts the space available for flow ducts. Additionally, the inside threads are difficult to clean.

Such containment systems may utilize dispense heads and down tube assembles for withdrawal by suction of the chemicals in the drums. Conventionally, such dispense heads and down tube assemblies are structurally complex, have several sealing surfaces, and thus are required to be precisely molded or machined. A containment system is needed that utilizes a simplified dispense head and down tube assembly each with a minimal number of sealing surfaces.

A simple containment system is needed that provides sealing and connection surfaces for closures and dispense heads for high purity chemicals such as used in the semiconductor processing industry. Such a system should have structurally simple components, a minimal number of o-rings, and provide connections and closures of high integrity.

Closures for such ports may or not be vented and may have valves for discharging pressure buildup in the drum. Such closures typically are formed of multiple components with exteriorly exposed openings, perforations, tool recesses, and interfaces between the components. Such openings, interfaces, recesses, and perforations may operate as collection points for impurities, contaminants, the contents of the drum, or other matter. Additionally such openings, perforations, and interfaces provide a pathway for leakage of the contents of the drum or for entry of contaminants into the interior of the drum. A closure is needed that has the minimal number of perforations, vents, and interfaces between components. Ideally, such a closure will have a smooth outer shell completely covering the neck without any exposed perforations, openings, or interfaces between components of the closure.

Moreover, a closure sealing directly with the inside threads, such as a plug, as opposed to a closure on a secondary fitting, will require tightening said plug directly and the requirement that the closure does not have UV inhibiting additives in contact with the drum contents necessitates that the exterior of the plug also be free of UV inhibitors which is not an ideal situation. A closure is needed in which the component part that is being tightened with the threads on the neck is not the component part which is sealing the neck opening and which is exposed to the contents of the drum.

SUMMARY OF THE INVENTION

A blow molded drum has a port including a neck with exterior buttress threads and a port opening having a sleeve fusion bonded in the neck. The sleeve having a inner cylindrical sealing surface, and a shoulder. A drop-in down tube assembly seats with the shoulder and has an upwardly extending nipple. Either a dispense head or a closure radially seals within the sealing surface of the sleeve and is secured by a retainer with interior buttress threads engaging with the exterior threads on the port neck. The dispense head has a first flow duct extending to a nipple engaging portion to seal with the upwardly extending nipple and a second flow duct leading to an annular space around the nipple for a return fluid line or for providing air or a gas for displacing withdrawn fluid. The closure is preferably comprised of a cylindrically shaped interior liner portion for engaging and sealing with the cylindrical sealing surface of the sleeve, such as by an o-ring, and has a pathway which includes the spiral gap between the cooperating buttress threads on the neck and on the retainer. A microporous membrane may be placed in the pathway to allow venting of gases but preclude leakage of the liquid in the drum.

An advantage and feature of the invention is that the down tube assembly simply drops in and snaps in place.

An advantage and feature of the invention is that the down tube assembly utilizing the nipple provides a simple connection providing a reliable seal of high integrity.

An advantage and feature of the invention is that the simplified down tube assembly is easily assembled, is relatively inexpensively manufactured and thus facilitates one-time use of the drum and down tube assembly.

An advantage and feature of the invention is that with the closure in place as described on a multiple layer drum, all outwardly exposed polyethylene of the closure may have UV light inhibitors while all of the polyethylene exposed to the contents of the drum will not. Moreover, the sealing is accomplished with the two component parts of the closure only loosely coupled together. That is, the torque is not transferred from the shell to a separate component which is engaging the threads on the neck. Additionally, the criticality of the tightening of the shell portion is minimized in that the radial seal of the cap liner is not dependant thereon.

DETAILED DESCRIPTION OF PREFERRED EMBODIMENTS

Figure 1:
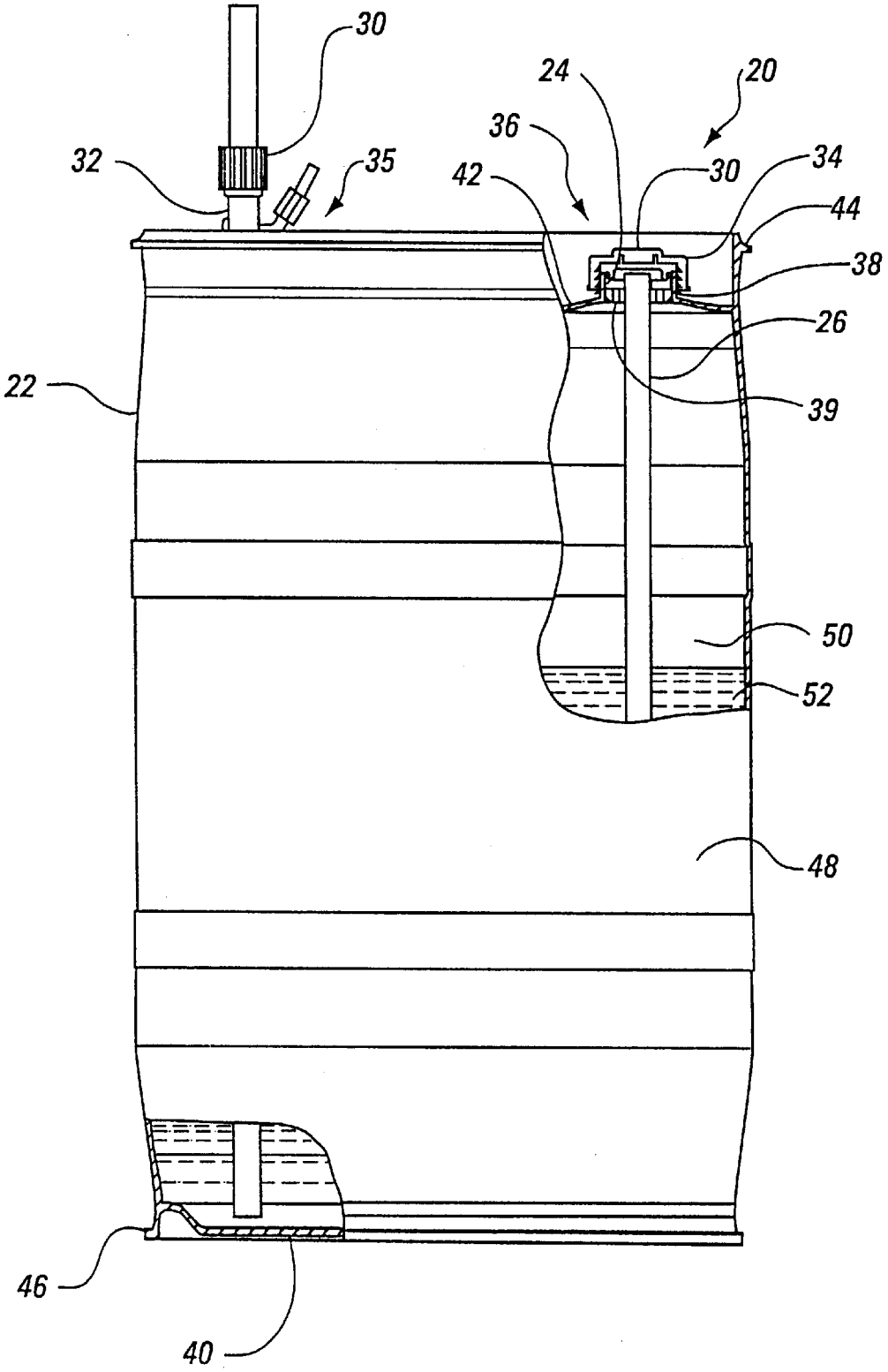
FIG. 1 is an elevational view of the containment system with portions of a drum and closure cut-away to reveal particular details.

Referring to FIG. 1 a containment system according to the invention is shown and is generally indicated by the numeral 20. The principal components of the invention are a blow molded drum 22 with a fusion bonded sleeve 24, a down tube assembly 26, and a port fitting assemblage 30 which may either be a dispense head 32 or a closure 34. The drum includes a pair of ports 35, 36 each of which have a neck 38 and a port opening 39.

The blow molded drum is similar to those known in the art in the sense that it has a substantially flat bottom 40, a substantially flat top 42, an upper chime 44, and a lower chime 46. A side wall 48 which is substantially cylindrical and an open interior 50 for holding typically ultrapure chemical contents 52.

Figure 2:
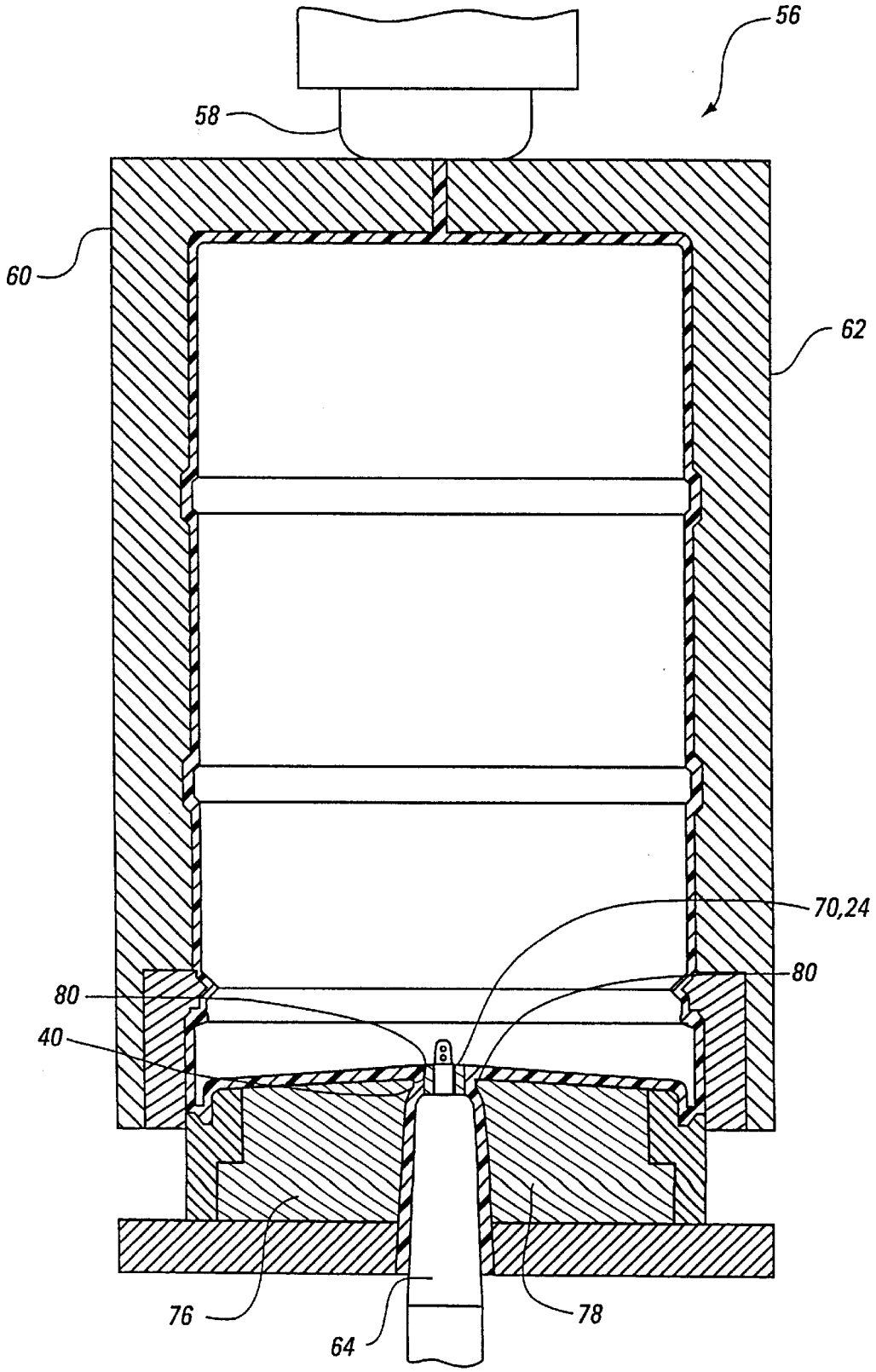
FIG. 2 is a cross-sectional elevational view of a blow mold apparatus for making drums in accordance with the invention herein.

Referring to FIG. 2 a cross-section of a blow mold apparatus generally of the type suitable for forming such blow molded drums is illustrated. The blow mold apparatus 56 has a parison extrusion portion 58, a pair of mold halves 60, 62 and a blow pin 64. The blow pin 64 in the preferred embodiment has a injection molded sleeve 70 inserted thereon prior to the commencement of the blow molding process. When the mold portions come together, the parison is squeezed against said injection molded sleeve portion and is fusion bonded thereto. The mold portions 76, 78 will have thread forming surfaces 80 thereon to form preferably exterior buttress threads on the neck 38 of the blow molded drum. The sleeve may have suitable structure to facilitate a secure mechanical connection.

Figure 4:
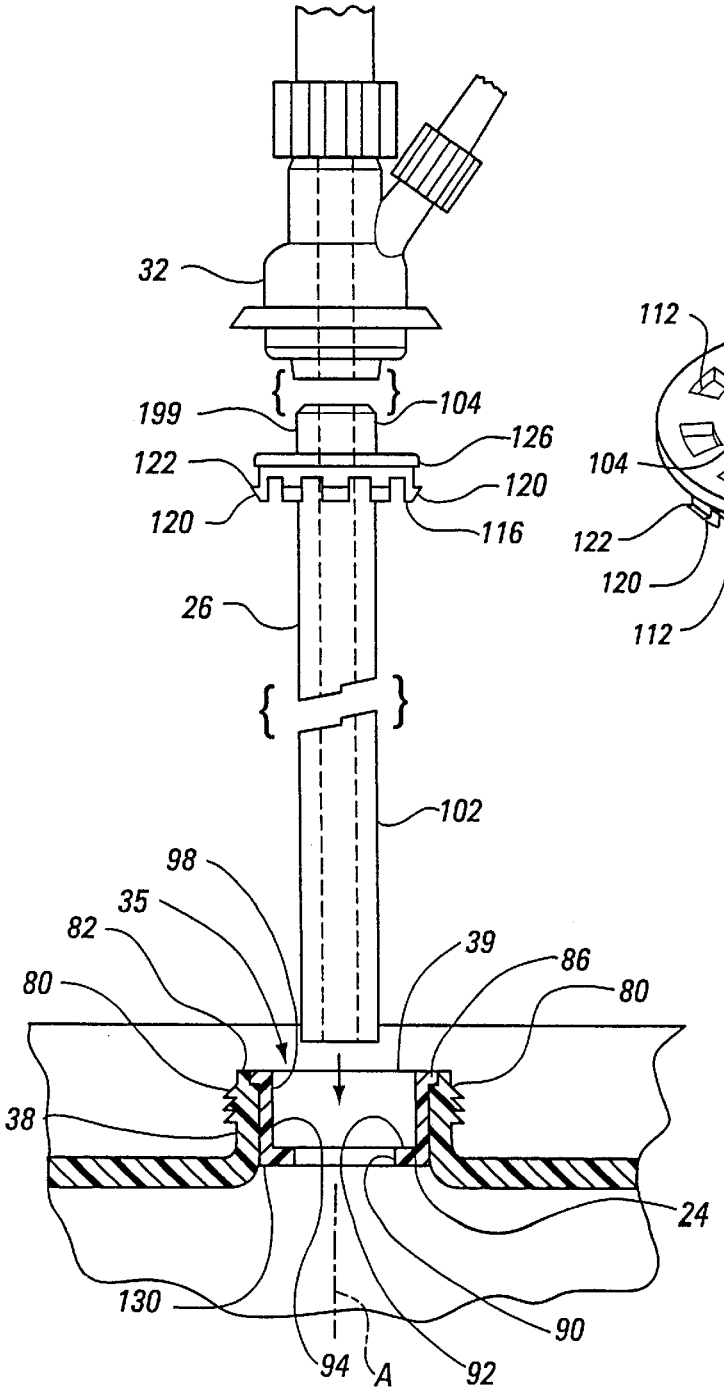
FIG. 4 is a exploded view of a down tube assembly, a dispense head, and a port of a drum.
Figure 6:
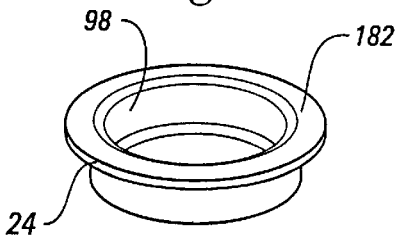
FIG. 6 is a perspective view of a sleeve in accordance with the invention.

Referring to FIGS, 3, 4, 5 and 6, details of a port 35, a port fitting assemblage 30 and the down tube assembly 26 are shown. FIG. 4 is an exploded view of the down hole assembly 26, the port 35, and the dispense head 32. The port 35 includes the neck 38 which has exterior buttress threads 80, a top edge 82, as well as the port opening 39. Within the neck 38 is the sleeve 24 which is shown in perspective view in FIG. 6. The sleeve has an upper lip 86, a first engagement structure 90 configured as a shoulder with a sitting surface 92. The sleeve has a inner periphery 94 which is substantially cylindrical and includes an O-ring sealing surface 98. Note that the port 32 has an axis A and the neck and cylindrical periphery 94 are coaxial therewith.

Figure 3A:
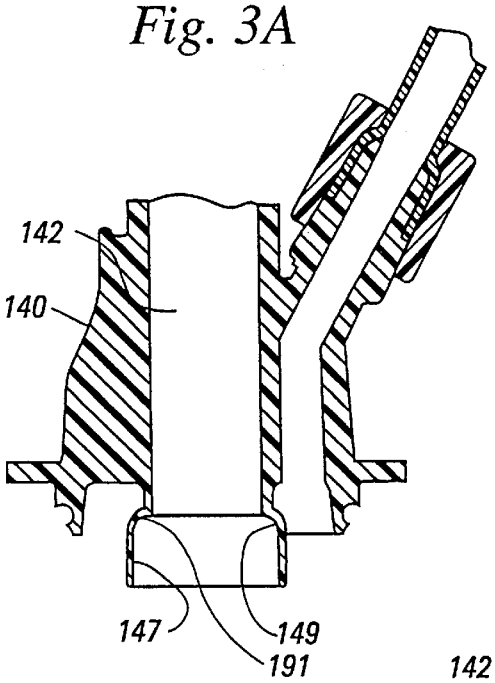
FIG. 3A is a cross-sectional view of a dispense head with an alternate nipple engaging portion.
Figure 3:
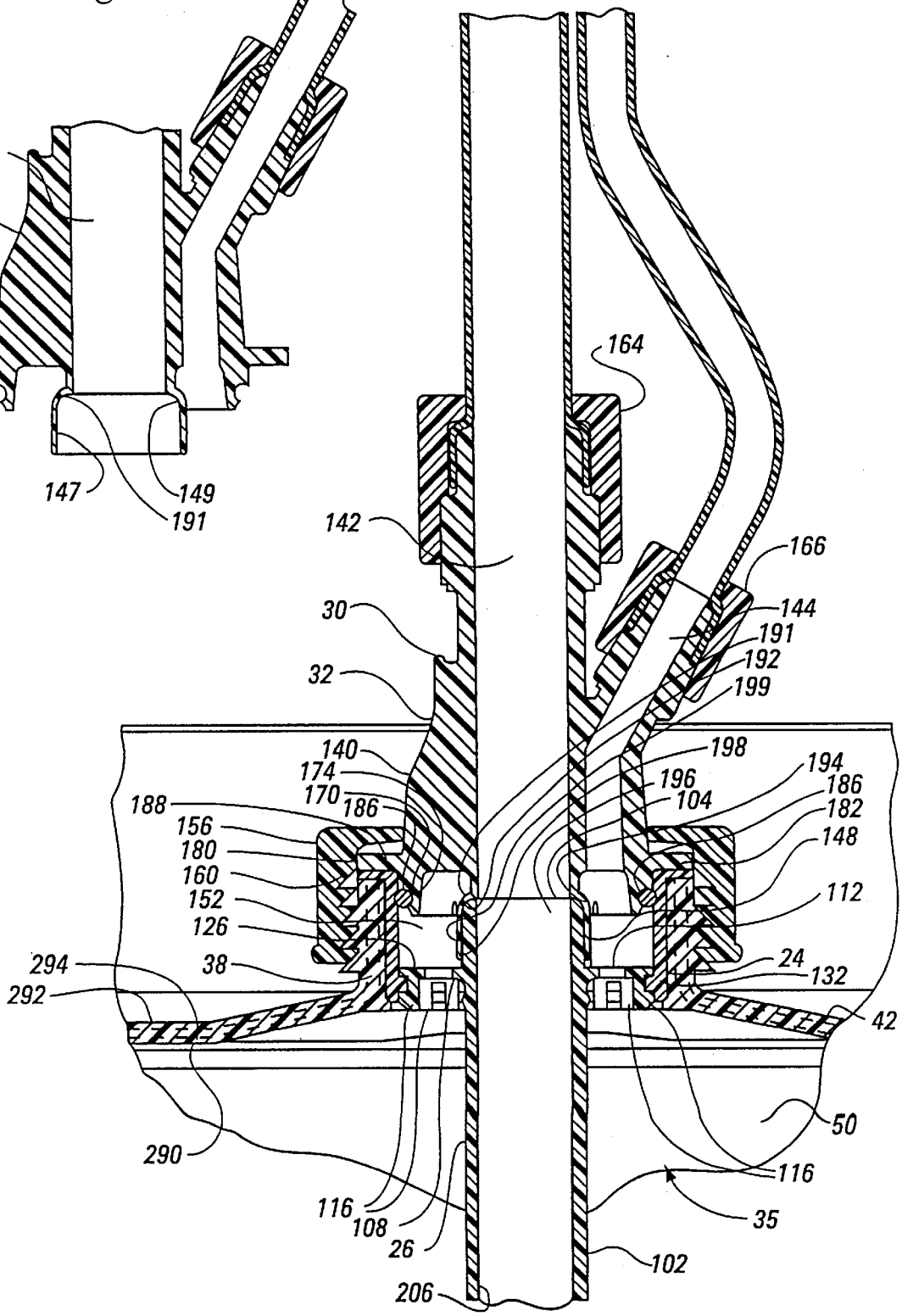
FIG. 3 is a cross-sectional elevational view of a dispense head and port of a plastic drum.
Figure 5:
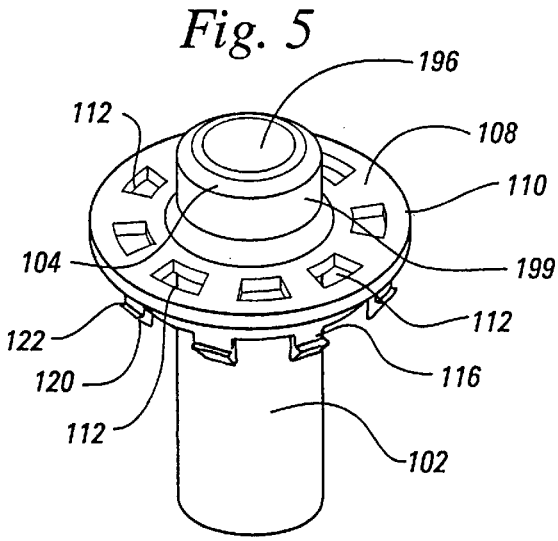
FIG. 5 is a perspective view of a down tube assembly.

Continuing to refer to FIGS. 3, 4, and 5, the down tube assembly 26 is comprised of a down tube 102, a nipple 104, and an annular support member 108. The annular support member 108 has a periphery 110 and a plurality of annular passages 112. At the periphery 110 is second engagement structures 116 configured as downwardly extending fingers with inclined wedge portions 120 and engagement surfaces 122. The annular support member also has a stop member 126 configured as a flange.

Referring specifically to FIG. 3, the down tube assembly 26 drops down into the port opening 39 "snaps" onto, seats on, and engages the sleeve 24 at the shoulder 90. The engagement surfaces 122 of the fingers 116 lock on the lower surface 130 of the shoulder. The flange 126 of the annular support member seats on the top of the shoulder. Four second engagement structures 116 are shown in FIG. 3, two of them in cross-section.

In the preferred embodiment, the sleeve 24 is fusion bonded at the interface 132 between the neck 38 and the sleeve. Alternate means of sealing engaging may be suitable in particular applications such as welding, adhesives, threaded engagement.

Continuing to refer to FIG. 3, the dispense head 32 is comprised of a body 140 with a central first flow duct 142 and a second flow duct 144. The dispense head 32 also has a nipple engaging portion 148 configured as a piece of flared tubing size to fit and sealing engage with the nipple 104. FIG. 3A shows an embodiment of the nipple engaging portion 148 configured as a bore 147 with a converging section 149. Extending around the nipple 104 and the nipple engaging portion 148 is an annular space 152. Said annular space is in flow communication with the second flow duct 144. The annular passages 112 also connect to said annular space 152 and thus connect the second flow duct 144 to the interior 50 of the drum adjacent the top 42. The dispense head also has a retainer 156 configured as a nut and has interior buttress threads 160 shaped and sized to cooperate with the exterior buttress threads on the neck 38. The dispense head has two connector portions 164, 166 for connecting the first flow duct and the second flow duct respectively to tubing. The connector portions as shown are configured as the flared tubing connectors available from Fluoroware, Inc., the assignee of the invention, and sold under the trademark FlareTek®.

The body 140 which may suitably be injection molded of perfluoroalkoxy (PFA) has a cylindrical portion 170 with a circular periphery 174 which in the embodiment shown comprises an O-ring groove. The body also has a flanged portion 180 extending radially outward which engages with the retainer 156 and is clamped between said retainer and the top surface 182 of the sleeve. The primary seal between the dispense head and the port is at the O-ring 186 which in this embodiment provides essentially a pure radially seal. In other words, the axial force provided by the dispense head being clamped to the port by the retainer 156 does not affect the compression of the O-ring 186 or the integrity of the seal provided thereby. The o-ring may suitably be formed of silicon encased in fluorethylene propylene (FEP). Secondary sealing may be provided by the interface 188 between the flange 180 and the top surface 182 of the sleeve.

The nipple engaging portion 148 is appropriately sized such that the clamping provided by the retainer positions the shoulder 191 and its annular engaging surface 192 against the upper peripheral surface surrounding the opening 196 of the nipple 104. The nipple engaging portion 148 thus seals at the upper peripheral surface and also is suitably sized such that there is also a radial seal between the cylindrical portion 198 of said flared tube and the outer cylindrical surface 199 of the nipple. The first flow duct is sized consistent with the bore 206 through the down tube assembly.

The down tube assembly may be suitably formed from separate injection molded or machined plastic components which are welded or otherwise suitably joined.

Referring to FIGS. 7, 8, 9, 10, and 11, views of a port fitting assembly 30 configured as a closure 34 and components thereof are depicted. The closure is comprised of a body 212 configured as a cap liner 220 rotatably engaged within a retainer configured as shell portion 222 which has internal buttress threads 226 at a substantially cylindrical side wall 230 which is integral with a top portion 232 which has a periphery 234. The cap liner 220 has a downwardly extending cylindrical portion 240 with a circular periphery 242 configured as an O-ring groove supporting the O-ring 244. Said O-ring radially seals against the inner cylindrical periphery 94 of the sleeve 24. The liner may be solid, without perforations, or alternatively may have a microporous membrane 250 affixed in a recess 252 with perforations 260 extending through the cap liner into the interior space 264 between the shell portion and the cap liner defining a pathway 270. The pathway further extends to and is comprised of the spiral gap 266 between the interior buttress threads 226 and the exterior buttress threads 80 of the neck 38. The buttress threads are configured to have said gap 266 constituting the pathway 270 whether the closure is tightly or loosely secured to the neck 38.

Figure 7:
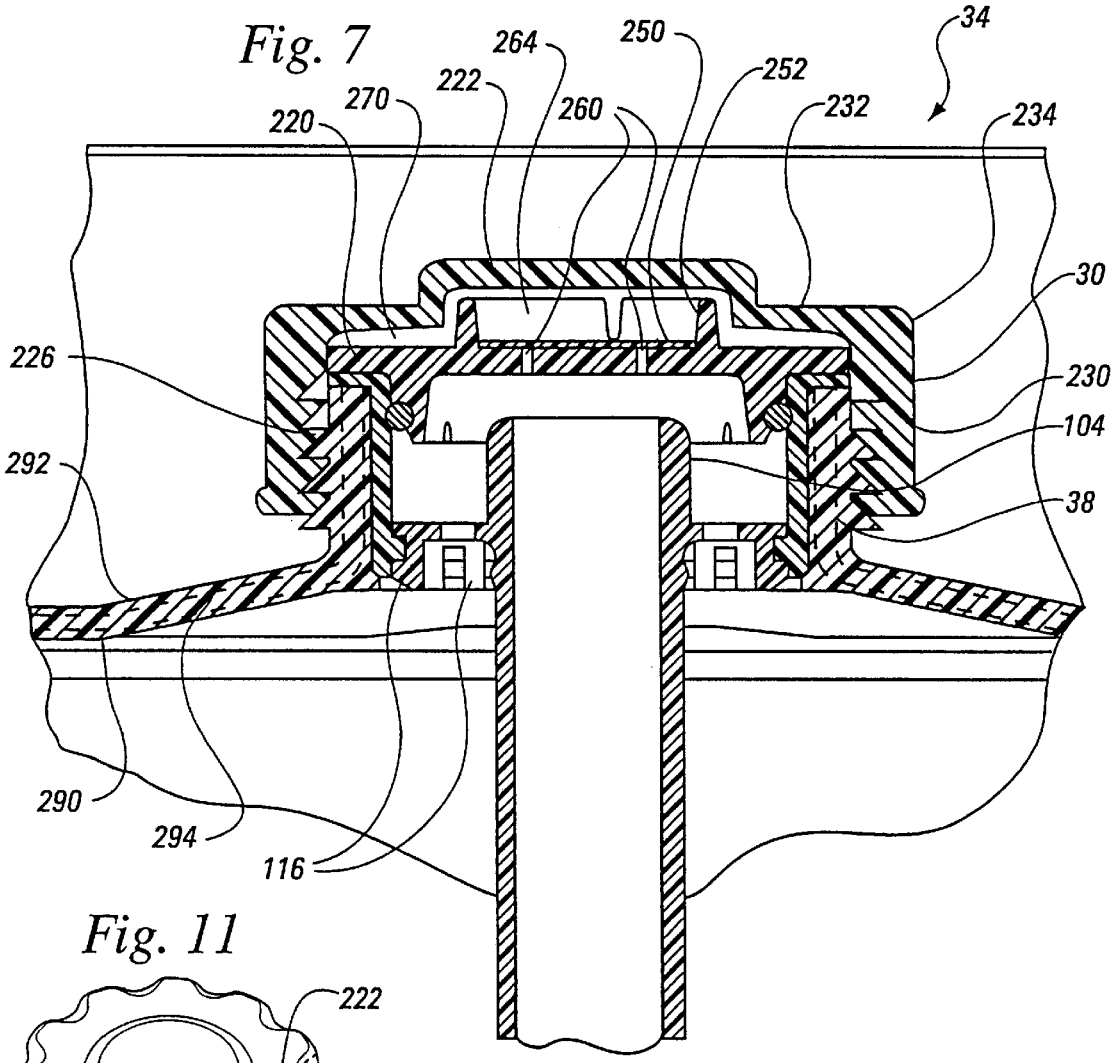
FIG. 7 is a cross-sectional view of a closure in place on a port in accordance with the invention.
Figure 11:
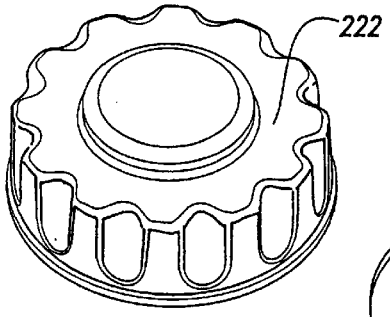
FIG. 11 is a perspective view of a shell portion of a closure.
Figure 10:
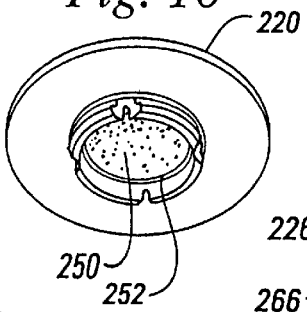
FIG. 10 is a top view of the cap liner of FIG. 9.

The shell portion 222 of the closure in the preferred embodiment will have ultraviolet light inhibitor additives. The cap liner 220 is preferably formed of an ultrapure polyethylene without having additives such as ultraviolet light inhibitors. The cap liner may be formed of the same highly pure polyethylene that is on the interior contact surface 290 of the drum. Referring to FIG. 7, three layers of the wall are portrayed by way of the dashed lines. The inner layer 290 will be of ultrapure polyethylene. The exterior layer 292 will typically be formed of a polyethylene with the ultraviolet light inhibitors. The inner layer 294 can be comprised of recycled scrap polyethylene originating from the molding process or from recycled drums. Thus with a multiple layer drum and the closure of FIG. 7, no polyethylene with UV light inhibitors is exposed to the contents of the drum and no ultrapure polyethylene is exteriorly exposed when the closure is in place.

Figure 8:
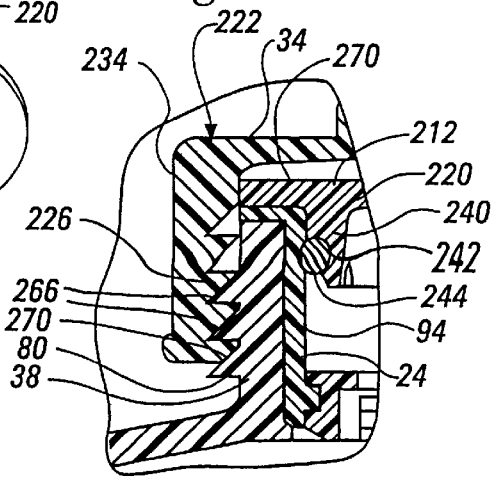
FIG. 8 is a detailed cross-sectional view of a portion of a closure engaged with a port of drum in accordance with the invention.
Figure 9:
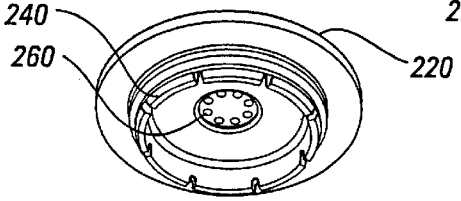
FIG. 9 is a bottom view of a cap liner in accordance with the invention.

Referring to FIG. 8, and particularly the o-ring 242, a significant aspect of the invention is depicted. The o-ring sealing surface 98 is on the upright, substantially vertical, non grooved cylindrical side wall 298. Thus, a seal is provided with minimal or no axial loading on the o-ring, a substantially pure radially loaded seal which facilitates longer seal life and less critical tightening of the retainer 222.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A containment system comprising:

a plastic drum having a generally flat top and a generally flat bottom, the top having a port with a port opening and a neck portion extending upwardly from the top and integral therewith, the neck portion having exterior threads;

a plastic sleeve positioned in the neck portion and sealingly engaged therewith, the sleeve having an inner cylindrical periphery including an o-ring sealing surface and a shoulder extending inwardly from said inner cylindrical periphery below and displaced from the o-ring sealing surface;

a down tube assembly consisting of a down tube sized to extend down toward the bottom of said drum, an upwardly extending nipple, the down tube and nipple having a bore extending therethrough, the nipple connecting with said down tube, and an annular support member extending radially from the nipple with a circular periphery sized to seat on the shoulder, the support member having at least one annular passage, the down tube assembly configured such that said assembly is insertable downwardly into the port opening such that the circular periphery seats on said shoulder positioning the nipple to extend upwardly in the cylindrical sleeve and fixing the position of said down tube assembly; and a port fitting assemblage engageable on said port, said assemblage having a body with a circular periphery sized to the inner cylindrical periphery of the sleeve, an o-ring extending around the body for sealing with the cylindrical periphery, a retaining member rotatable with respect to said body, the retaining member having inwardly extending threads sized for engagement with the threads on the exterior of the neck portion.

2. The containment system of claim 1 wherein the port fitting assemblage is a dispense head, the body of said dispense head having a downwardly extending nipple engaging portion sized to slidingly and sealingly engage with the upwardly extending nipple.

3. The containment system of claim 2 wherein the upwardly extending nipple has an opening with an upper peripheral surface surrounding the opening and wherein the nipple engaging portion has an interior converging section to contact in an axially direction the upper peripheral surface of the nipple.

4. The containment system of claim 3 wherein tightening the retainer member pushes the annular engaging surface of the nipple engaging portion downwardly to axially engage and seal in an axial direction said annular engaging surface with the upper peripheral surface of the nipple.

5. The containment system of claim 3 wherein the nipple engaging portion is tubular and flared and seals with the nipple without additional sealing components.

6. The containment system of claim 1 wherein the port fitting assemblage is a closure, and wherein the body has a top surface and wherein the retainer extends laterally around the body of the assemblage.

7. The containment system of claim 6 wherein the retainer comprises a top portion which extends over and covers the top surface of the body and wherein the retainer extends laterally around the body as a retainer sidewall and wherein the top portion and side wall are integral and contiguous.

8. The containment system of claim 1 wherein the O-ring engages the sleeve only at a substantially vertical surface.

9. The containment system of claim 1 wherein the down tube assembly snaps into place on the shoulder.

10. A containment system comprising:

a plastic drum having a generally flat top and a generally flat bottom, the top having a port with an inner cylindrical surface defining a port opening and a neck portion extending upwardly from the top and integral therewith, the neck portion having threads and a vertical axis;

a down tube fixed in the neck portion and extending down toward the bottom of said drum, the down tube including an upwardly extending nipple, said down tube extending upwardly and into the port opening; and a port fitting assemblage engageable on said port, said assemblage having a body with a circular periphery sized to the inner cylindrical surface, an O-ring extending around the body for sealing with said inner cylindrical surface, a retaining member rotatably engaged with respect to said body, the retaining member having inwardly extending threads sized for engagement with the threads on the exterior of the neck portion whereby the assemblage may be secured on the port.

11. The containment system of claim 10, wherein the port fitting assemblage is a dispense head, the body of said dispense head having a downwardly extending nipple engaging portion sized to sealingly engage with the upwardly extending nipple.

12. The containment system of claim 10, wherein the port fitting assemblage is a closure, and wherein the body has a top surface and wherein the retainer extends laterally around the body of the assemblage and covers the top surface of the body, the retainer being integral and contiguous.

13. The containment system of claim 12, wherein the down tube is part of a down tube assembly and wherein said assembly may be dropped into the port opening.

14. The containment system of claim 13, wherein the port has a inwardly extending shoulder and the down tube assembly engages with the shoulder to retain the drop tube assembly in place.

15. The containment system of claim 10 further comprising a sleeve sealingly engaged with the neck portion and wherein the inner cylindrical surface is part of said sleeve.

16. A containment system comprising:

a plastic drum having a generally flat top and a generally flat bottom, the top having a port with a port opening, a neck portion extending upwardly from the top and integral therewith, the neck portion having threads and a vertical axis, a down tube assembly suspended from the port and comprising a down tube sized to extend down toward the bottom of said drum, the down tube having at least two flow passageways with one flow passageway connecting to the nipple, an upwardly extending nipple with a circumferential outer surface;

a dispense head engageable on said port, said dispense head having a body, a retaining member rotatable with respect to said body, and having threads sized for engagement with the threads on the neck portion, and a downwardly extending nipple engaging portion configured with an interior cylindrical surface to directly engage and seal with the circumferential outer surface of the upwardly extending nipple thereby connecting the down tube to the first flow duct.

17. The containment system of claim 16 further comprising a plastic sleeve positioned in the neck portion and sealingly engaged therewith, the sleeve having a cylindrical inner periphery with a sealing surface.

18. The containment system of claim 17 wherein the plastic sleeve is fusion bonded with the plastic drum.

19. The containment system of claim 16 wherein the port has an inner cylindrical periphery with an O-ring sealing surface and the dispense head body has a downwardly extending portion with a circular periphery and an O-ring at said circular periphery, said downwardly extending portion and O-ring sized for sealing with the inner cylindrical periphery.

20. The containment system of claim 18 wherein the down tube assembly has a second passageway and wherein first flow duct is in flow communication with said second passageway.

21. A containment system comprising:

a plastic drum having a top and a bottom, the top having a port with a port opening, a neck portion extending upwardly from the top and integral therewith, the port having exterior buttress threads, the port opening having a smooth interior surface defining a bore extending into the drum;

a closure for the drum port comprising:

a cap liner comprising a first sealing portion having a cylindrical surface extending downwardly from the body portion and sized for insertion into the bore, the first sealing portion having an o-ring receiving region thereon, a second sealing portion comprising a flange integral with the first sealing portion and extending radially outward therefrom, the second sealing portion having a downwardly facing surface for contacting the top surface of the port;

a shell portion with the cap liner rotatably attached thereto, the cap liner inserted within the shell portion, the shell portion having a top portion with a periphery and a substantially cylindrical side wall integral with the top portion and extending downwardly therefrom, the side wall having interior buttress threads;

the interior buttress threads sized to cooperate with the buttress threads on the drum neck and also sized to allow a gap extending along the threads, the cap further having a pathway extending through the liner portion and to the gap extending along the threads whereby when the cap is secured on the drum a passage is established from the interior of the drum to the exterior without any perforations in the shell portion; and a porous micromembrane positioned in the pathway, the micromembrane configured for preventing the passage of liquid in the drum while allowing the passage of gas.

22. The containment system of claim 21, wherein the shell portion is injection molded of thermoplastic with a ultraviolet light inhibitor added.

23. The containment system of claim 22, wherein the liner portion is injection molded of thermoplastic without an ultraviolet light inhibitor.

24. The containment system of claim 23, wherein the drum is blow molded with at least an inner layer and an outer layer of melt processable thermoplastics and the inner layer does not have ultraviolet light inhibitors.

25. A closure for a plastic drum of the type having a top and a bottom, the top having a port with a port opening, a neck portion extending upwardly from the top and integral therewith, the port having exterior buttress threads, the port opening having a smooth interior surface defining a bore extending into the drum, the closure comprising:

a cap liner comprising a first sealing portion having a cylindrical surface extending downwardly from the body portion and sized for insertion into the bore, the first sealing portion having an o-ring receiving region thereon, a second sealing portion comprising a flange integral with the first sealing portion and extending radially outward therefrom, the second sealing portion having a downwardly facing surface for contacting the top surface of the port;

a shell portion with the cap liner rotatably attached thereto, the cap liner inserted within the shell portion, the shell portion having a top portion with a periphery and a substantially cylindrical side wall integral with the top portion and extending downwardly therefrom, the side wall having interior buttress threads;

the interior buttress threads sized to cooperate with the buttress threads on the drum neck and also sized to provide a gap extending along the threads, the cap further having a pathway extending through the liner portion and to the gap extending along the threads whereby when the cap is secured on the drum a passage is established from the interior of the drum to the exterior without any perforations in the shell portion; and a porous micromembrane positioned in the pathway, the micromembrane configured for preventing the passage of liquid in the drum while allowing the passage of gas.

26. A containment system comprising:

a blow molded plastic drum having a top and a bottom, the top having a port with a port opening, a neck portion extending upwardly from the top and integral therewith, the port having threads, the drum blow molded with at least an inner layer of a first formulation of a melt processable plastic and an outer layer of a second formulation of a melt processable plastic, said first formulation including a ultraviolet light inhibitor and said second formulation not having said ultraviolet light inhibitor;

a closure for the drum port comprising:

a cap liner formed of a formulation of melt processable plastic not including ultraviolet light inhibitors and comprising a first sealing portion having a cylindrical surface extending downwardly and sized for insertion into the bore;

a shell portion formed of a formulation of melt processable plastic having an ultraviolet light inhibitor, the shell portion having a top portion with a periphery and a substantially cylindrical side wall integral with the top portion, extending downwardly therefrom and extending down the neck portion of the drum when the closure is attached thereto, the exterior surface of the shell portion integral and continuous, the cap liner rotatably attached within the shell portion and the cap liner and shell portion configured such that when the closure is secured to the drum port only the shell portion is exposed; and the closure having threads sized to cooperate with the threads on the drum port.

* * * * *